US005084915A

United States Patent [19]

Shotwelkl et al.

[11] Patent Number: 5,084,915

[45] Date of Patent: Feb. 4, 1992

[54] METHOD OF DISPLAYING INFORMATION

[76] Inventors: James M. Shotwelkl, 420 Porter St.; Fred W. Stellabotte, 3548 Rosa Way, both of, Fallbrook, Calif. 92028

[21] Appl. No.: 554,677

[22] Filed: Jul. 19, 1990

[51] Int. Cl.[5] ..... A41B 1/00

[52] U.S. Cl. ..... 2/115; 2/246; 40/586

[58] Field of Search ..... 2/115, 113, 114, 53, 2/54, 246; D2/208, 212, 209

[56] References Cited

U.S. PATENT DOCUMENTS

D. 286,220 10/1986 Irwin ..... 2/115
2,399,428 4/1946 Daniels ..... 2/115
2,871,485 2/1959 Greco ..... 2/246
3,484,974 12/1969 Culmone ..... 2/115
4,354,282 10/1982 Langdon ..... 2/115
4,710,981 12/1987 Sanchez .

*Primary Examiner*—W. Reynolds
*Assistant Examiner*—Amy Brooke Vanatta
*Attorney, Agent, or Firm*—Loyal M. Hanson

[57] ABSTRACT

A method of displaying information comprises the steps of applying informational indicia to the armpit regions of a shirt so that the indicia are substantially concealed when a wearer of the shirt has their arms lowered by their sides, a wearer donning the shirt, and the wearer raising their arms above their head to reveal the informational indicia. Preferably, the indicia are in two successive, different parts, the first part being applied to the right armpit region and the second part being applied to the left armpit region.

8 Claims, 2 Drawing Sheets

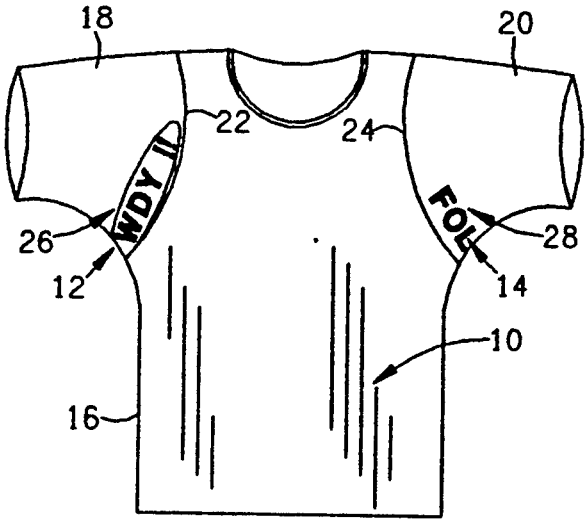
FIG. 1
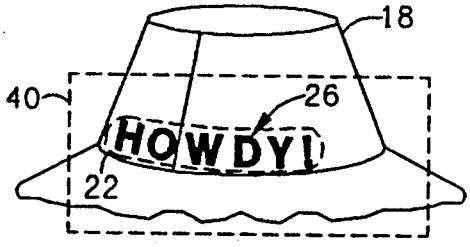
FIG. 2
FIG. 3
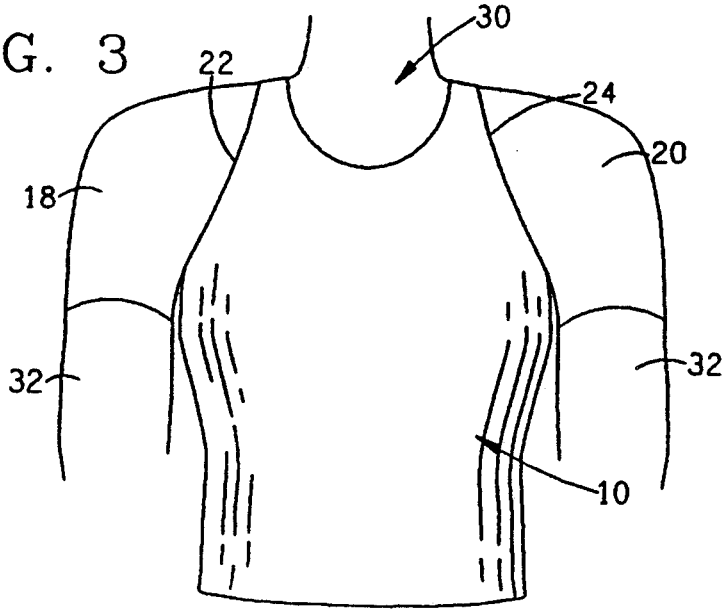

FIG. 4
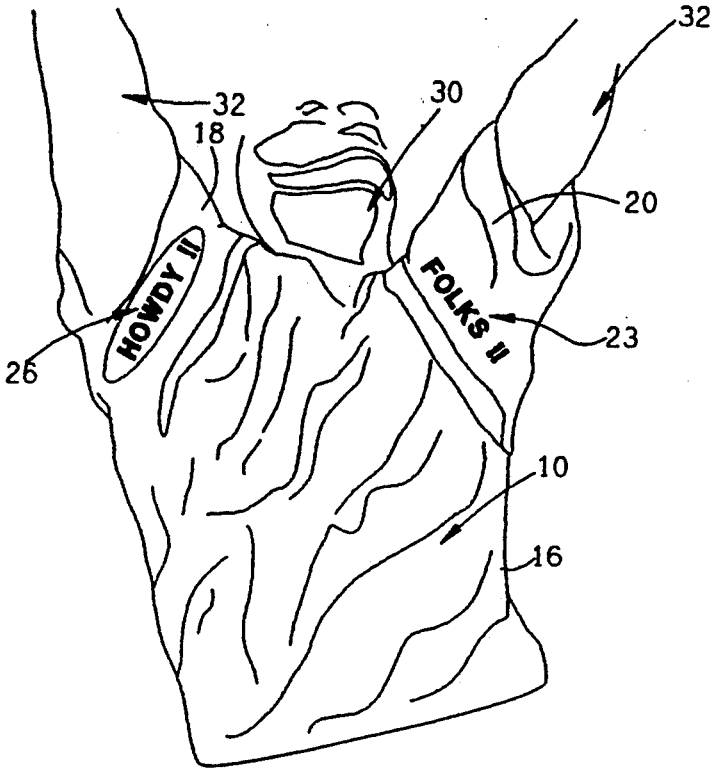
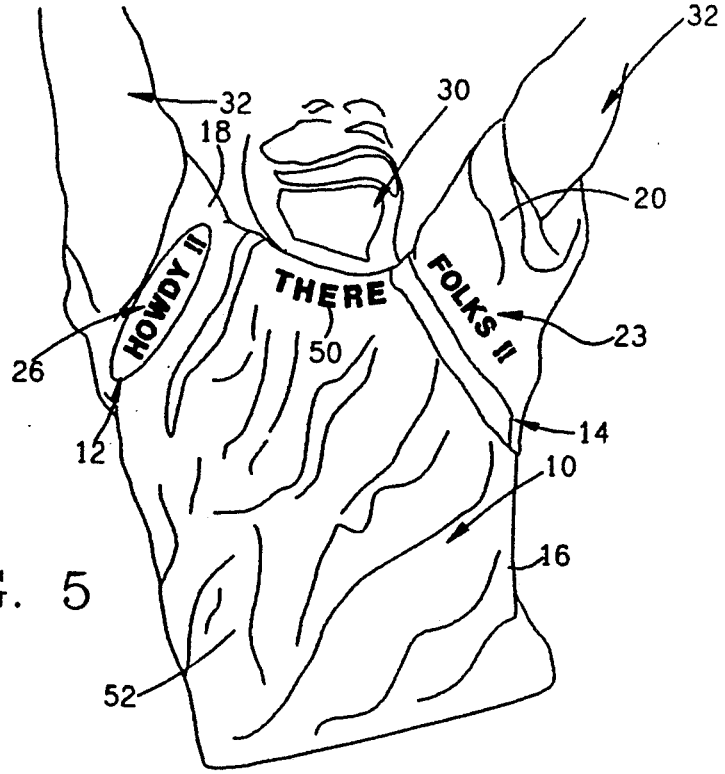
FIG. 5

METHOD OF DISPLAYING INFORMATION

BACKGROUND OF THE INVENTION

1. Field of the Invention

This invention relates generally to methods of displaying information on items of clothing for advertising and other purposes.

2. Description of Related Art

It is known to apply informational and other indicia to items of clothing such as T-shirts, both to provide an attractive appearance to the clothing and also, in some cases, to provide an informational message, such as an advertising slogan, the logo or name of a sporting team supported by the wearer, an amusing slogan, the wearer's name, and other similar facts. However, such information is generally applied to the front or rear face of the shirt, where it is always visible.

SUMMARY OF THE INVENTION

It is an object of the present invention to provide a new and improved method of displaying informational indicia on an item of clothing such as a T-shirt.

According to the present invention, a method of displaying information is provided, which comprises the steps of applying informational indicia to the region of a shirt corresponding to at least one of a wearer's armpits, a wearer donning the shirt, the wearer holding their arms by their side to at least substantially conceal the indicia, and raising at least one arm above their head to reveal the informational indicia.

In the preferred embodiment of the invention, the indicia are applied to both armpit regions of the shirt. Additional information may be applied to the front of the shirt. It is common at sporting events for spectators to raise their arms in a cheer when their team wins points in the game. Another common crowd activity at sporting events is known as "The Wave", when successive sections of the crowd rise to their feet in turn while waving their hands above their heads, creating the impression of a wave travelling around the stadium. This activity also occurs at popular music concerts and the like. The display method of this invention takes advantage of this phenomenon to allow an informational message to be imparted to observers viewing the sporting event on a television set, for example, or even to adjacent members of the crowd in the audience of any sporting or other cultural activity. This display method may also be used in other activities involving repeated raising of the arms, for example, in sports such as tennis or volleyball.

The same message may be applied in both armpit regions of the shirt, but in the preferred embodiment of the invention the message is in a two part form, reading from right to left on the shirt, so that the right and left armpit message sections must be read together make up the entire message. This potentially may have more visual impact than a message which is always visible on the front of a T-shirt, where viewers will tend to tune it out or ignore it. However, the sudden and unexpected appearance of a message as the wearer raises their arms would prompt most observers to try to read what the wearer intended to convey. This method may be used for advertising as well as other informational purposes.

The information may be applied to the shirt in any suitable manner, including stamping, stenciling, applique, sewn on patches, printing techniques, such as silk screen printing, and the like.

According to another aspect of the invention, a shirt for displaying informational indicia is provided, which comprises a body portion for covering the upper torso of a wearer, having an upper neck opening and an armhole opening at each side, and a pair of sleeves secured to the respective left and right armhole openings of the body portion, the sleeves and body portion together defining respective left and right armpit regions each surrounding a lower portion of the armhole and generally corresponding to the armpit region of a wearer, and informational indicia applied to the left and right armpit regions of the shirt so as to be completely visible only when a wearer raises their arms above their head.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which:

FIG. 1 is a front elevational view of a shirt for displaying information according to a preferred embodiment of the invention;

FIG. 2 is a view illustrating positioning of the shirt for applying a design to the armpit region of the shirt;

FIGS. 3 and 4 are views of the shirt illustrating the method of displaying information according to the preferred embodiment of the invention; and FIG. 5 illustrates a modified shirt having additional information imprinted on it.

DESCRIPTION OF THE PREFERRED EMBODIMENT

The drawings illustrate a method of displaying information according to a preferred embodiment of the present invention. In the drawings, the information is applied to a T-shirt 10. However, it will be understood that the method can be carried out on any item of external upper body wear, such as a zipper, Velcro or button front shirt, jacket, sweater, or upper part of a dress or blouse.

In the illustrated embodiment, a two part informational message or design is applied to the right and left armpit regions 12, 14 of a T-shirt 10 of standard shape having a body portion 16 for covering the upper torso of a wearer and sleeves 18, 20 secured along armhole seams 22, 24 to the respective right and left armholes of the body portion 16. The message includes a first part 26 applied to the right armpit region 12 and a second part 28 applied to the left armpit region 14, so that it reads sequentially from the right armpit region 12 to the left armpit region 14. It may be applied to the shirt in any suitable manner, including stenciling, stamping, applique, or sewing on patches carrying the information. Although in the preferred embodiment the message is in two parts or halves, so that the informational indicia applied to one armpit region of the shirt is different from that applied to the other armpit, in alternative embodiments the same indicia or designs may be applied to only one armpit, or the same indicia or design may be applied in both armpit regions. Any desired informational, advertising, or other purpose message may be conveyed by the indicia applied to the shirt, and the message or design indicated in the drawings is by way of example only.

FIG. 2 illustrates the positioning of the armpit region of the shirt for applying the desired message, which may be in the form of words, a design, or both. Any standard technique may be used for applying the informational or design indicia, such as the technique known as silk screen printing. Silk screen printing techniques are often used in T-shirt design. In such techniques, the desired design is painted onto a screen of silk, wire gauze, or the like. A water soluble gum is then applied to the screen, closing the unpainted pores. The paint is then washed away with a solvent, to produce a stencil of the desired design. The surface to be printed is then appropriately positioned to receive the design. In the present case, the arm of the T-shirt is flattened with its undersurface or armpit region facing upwards, as illustrated in FIG. 2. The screen or stencil 40 is then placed over this surface so that the design on the screen corresponds to the desired position on the shirt. Ink is then applied to the screen, for example, by means of a rubber squeegee. Ink soaks through the open pores of the screen onto the underlying surface. For more intricate designs, the stencil may be produced by a photographic process. Simple designs may be made by sticking paper, celluloid or metal patterns to the screen.

The other armpit design may be applied in a similar manner.

The message parts 26, 28 are positioned on the armpit regions of the shirt so that they will be substantially or completely concealed when the wearer 30 has their arms 32 lowered as illustrated in FIG. 3. FIGS. 3 and 4 illustrate the method of using the shirt by a wearer to convey a desired message. When a wearer 30 is wearing the shirt with their arms by their side, as seen in FIG. 3, the informational indicia in both armpit regions of the shirt will be substantially or completely concealed. In order to display the information, the wearer 30 raises the arms 32 as illustrated in FIG. 4, revealing the message. Since the message reads successively from the right armpit to the left armpit region, an observer in front of the wearer reads the message, e.g. "HOWDY FOLKS," in the normal manner from left to right. The message may include two or more words, and may be in the form of other indicia such as numbers, symbols, designs and so on. In the illustrated embodiment, the information is positioned to generally follow the seam liner 22 and 27 respectively, at the armpit of the shirt, reading from rear to front on the right hand armpit, and from front to rear on the left hand armpit so that it reads correctly in a successive manner when viewed from the front with the arms raised as in FIG. 4. The message is preferably centered on the armpit, but may be positioned off center towards the front of the shirt, depending on its size. The positioning is such that the complete message is visible to an observer located in front of the wearer with the wearer's arms raised.

FIG. 5 illustrates a modification in which an additional part 50 of the message is imprinted on the front 52 of the shirt, to form a continuous message with right and left armpit message parts 26 and 28. Thus, a message may be divided into three consecutive parts and applied to the right armpit region 12, center 52 and left armpit region 14, successively, so as to form a continuous message when the arms are raised.

This method of displaying information may be used by members of the crowd at sporting or other events, or in any other activity involving raising the arms repeatedly, for example when playing tennis, volleyball or similar sports. When the shirt is worn by a spectator at a sporting event or concert, the message is revealed each time the spectator raises their arms in a cheer. This message can be quite striking, for example, if large numbers of an audience wearing such shirts perform the so-called "wave", when sections of an audience in turn rise to their feet and wave their arms above their head, producing a "wave" effect extending around an arena or stadium. It is believed that informational indicia conveyed in this manner would have a significantly more striking effect than that produced, say, simply by having such information printed on the front of a shirt in a standard fashion so that it is always visible.

Although a preferred embodiment of the invention has been described above by way of example only, it will be understood by those skilled in the field that modifications may be made to the disclosed embodiment without departing from the scope of the invention, which is defined by the appended claims.

We claim:

1. A item of clothing for displaying information, comprising:

a body portion for covering the upper torso of a wearer, the body portion having an upper, neck opening and armhole openings at opposite, right and left sides;

a pair of sleeves secured along seamlines to the respective right and left armhole openings of the body portion;

regions of the sleeves and body portion adjacent the seamlines at the lower part of each armhole defining respective right and left armpit regions corresponding to the position of an armpit of a wearer wearing the item of clothing and the item of clothing informational indicia applied to at least part of at least one armpit region of the item so as to be substantially concealed when a wearer has their arms lowered, the indicia comprising means for conveying a message to an observer when the wearer raises at least one arm to reveal said one armpit region.

2. The item of clothing as claimed in claim 1, wherein the item of clothing carries information indicia on both armpit regions.

3. The item of clothing as claimed in claim 2, wherein the indicia applied to the right armpit region are different from those applied to the left armpit region.

4. The item of clothing as claimed in claim 3, wherein the informational indicia is two successive parts, the first part being applied to the right armpit region and the second part being applied to the left armpit region.

5. The item of clothing as claimed in claim 1, wherein the informational indicia in the right armpit region is positioned to read in a direction from the rear to the front of the item of clothing, and the informational indicia in the left armpit region is position to read in the opposite direction from the front towards the rear of the item of clothing.

6. The item of clothing as claimed in claim 1, wherein the informational indicia is positioned to substantially follow the seamline at the armpit region of the item of clothing.

7. The item of clothing as claimed in claim 2, wherein the item of clothing carries additional informational indicia on the front of the item of clothing.

8. The item of clothing as claimed in claim 7, wherein the informational indicia form a complete message when read from the right armpit region to the front and left armpit region of the item of clothing.

* * * * *

UNITED STATES PATENT AND TRADEMARK OFFICE

CERTIFICATE OF CORRECTION

PATENT NO. : 5,084,915

DATED : Feb. 4, 1992

INVENTOR(S) : James M. Shotwell and Fred W. Stellabotte

It is certified that error appears in the above-identified patent and that said Letters Patent is hereby corrected as shown below:

Title page, item [76] Inventors: should read --James M. Shotwell--.

Signed and Sealed this

Twentieth Day of April, 1993

*Attest:*

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,084,915

DATED : February 4, 1992

INVENTOR(S) : James M. Shotwell, et al

It is certified that error appears in the above-indentified patent and that said Letters Patent is hereby corrected as shown below:

Title page, item [19], the name of the inventor appearing under the words "United states Patent" is hereby changed from "Shotwelkl et al." to--Shotwell, et al --.

Title page, item [76], the name of the first inventor appearing on the front page of the patent to the right of the word "Inventors:" is hereby changed from "James M. Shotwelkl" to -- James M. Shotwell --.

This certificate supersedes Certificate of Correction issued April 20, 1993.

Signed and Sealed this

Twenty-first Day of February, 1995

*Attest:*

*Attesting Officer*

Bruce Lehman

BRUCE LEHMAN

*Commissioner of Patents and Trademarks*